US007059095B1

(12) United States Patent
Stevens et al.

(10) Patent No.: US 7,059,095 B1
(45) Date of Patent: Jun. 13, 2006

(54) ANCHORED MONOPOLE UPGRADE SYSTEM

(76) Inventors: James A. Stevens, 3725 Park Rd., Charlotte, NC (US); William A. Griswold, Jr., 1408 Woody Creek Rd., Matthews, Mecklenburg County, NC (US) 28105

( * ) Notice: Subject to any disclaimer, the term of this patent is extended or adjusted under 35 U.S.C. 154(b) by 242 days.

(21) Appl. No.: 10/269,708

(22) Filed: Oct. 11, 2002

(51) Int. Cl.
*E04H 12/00* (2006.01)

(52) U.S. Cl. ..... 52/651.01; 52/148; 52/157; 52/123.1; 248/541; 403/170

(58) Field of Classification Search ..... 52/651.02, 52/651.01, 148, 146, 157, 166, 123.1; 135/118; 248/533, 541, 530, 219.1; 211/107; 403/169–171, 403/175, 180, 217–219

See application file for complete search history.

(56) References Cited

U.S. PATENT DOCUMENTS

| | | | | |
|---|---|---|---|---|
| 2,410,246 | A * | 10/1946 | Scrivener et al. | 52/148 |
| 3,569,970 | A * | 3/1971 | Fenwick et al. | 343/724 |
| 3,845,597 | A * | 11/1974 | Foster | 52/166 |
| 4,146,897 | A * | 3/1979 | Wilson et al. | 343/882 |
| 4,800,690 | A * | 1/1989 | Bunce | 52/146 |
| 6,298,611 | B1 * | 10/2001 | Oliver et al. | 52/157 |

FOREIGN PATENT DOCUMENTS

GB 2121080 A * 12/1983

OTHER PUBLICATIONS

"Assembling Your Antenna System", LUXORION, Sep. 29, 2000, pp. 3-10.*

* cited by examiner

*Primary Examiner*—Naoko Slack
(74) *Attorney, Agent, or Firm*—Coats & Bennett, P.L.L.C.

(57) ABSTRACT

A monopole system has a free standing monopole tower and at least one collar assembly positioned around the tower having a plurality of radially projecting arms with holes. A plurality of anchor assemblies, each coupled to the ground around the tower and including a bracket having an aperture. A plurality of guy cables coupling one leg of each collar assembly with an aperture of an associated bracket.

13 Claims, 4 Drawing Sheets

ANCHORED MONOPOLE UPGRADE SYSTEM

BACKGROUND OF THE INVENTION

1. Field of the Invention

The present invention relates to a anchored monopole upgrade system and more particularly pertains to safely and efficiently supporting a monopole tower with antennas.

2. Description of the Prior Art

The use of pole and pole supports of known designs and configurations is known in the prior art. More specifically, pole and pole supports of known designs and configurations previously devised and utilized for the purpose of supporting poles through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, United States Patent Application Publication No. 2002/0069596 filed Feb. 15, 2001, by Charles Ritz, and published Jun. 13, 2002, discloses a system and method for supporting guyed towers having increased load capacity and stability. U.S. Pat. No. 5,247,776, issued Sep. 18, 1993, to Tamayo discloses a method for offshore rig up platform portable mast. U.S. Pat. No. 3,302,345 issued Feb. 7, 1967, to Ballantine discloses a tower. U.S. Pat. No. 4,850,161 issued Jul. 25, 1989, to McGinnis discloses an extensible mast support system. U.S. Pat. No. 6,351,250 issued Feb. 26, 2002, to Gillen discloses an antenna tower and support apparatus. U.S. Pat. No. 6,343,445 issued Feb. 5, 2002, to Ryan discloses a tower structure. U.S. Pat. No. 4,349,181 issued Sep. 14, 1982, to Asher et al. discloses an end or corner fence post construction. U.S. Pat. No. 5,581,962 issued Dec. 10, 1996, to Davis et al. discloses an antenna mast and support structure. U.S. Pat. No. 6,108,996 issued Aug. 19, 2000, to McGinnis discloses an apparatus and method for retrofitting towers exchanger. Finally, U.S. Pat. No. 945,475 issued Jan. 4, 1910 to Pfund discloses an aerial for the transmission and reception of electromagnetic wave energy.

While these devices fulfill their respective, particular objectives and requirements, the aforementioned patents do not describe an anchored monopole upgrade system that allows safely and efficiently supporting a monopole tower with antennas.

In this respect, the anchored monopole upgrade system according to the present invention substantially departs from the conventional concepts and designs of the prior art, and in doing so provides an apparatus primarily developed for the purpose of safely and efficiently supporting a monopole tower with antennas.

Therefore, it can be appreciated that there exists a continuing need for a new and improved anchored monopole upgrade system which can be used for safely and efficiently supporting a monopole tower with antennas. In this regard, the present invention substantially fulfills this need.

SUMMARY OF THE INVENTION

In view of the foregoing disadvantages inherent in the known types of pole and pole supports of known designs and configurations now present in the prior art, the present invention provides an improved anchored monopole upgrade system. As such, the general purpose of the present invention, which will be described subsequently in greater detail, is to provide a new and improved anchored monopole upgrade system and method which has all the advantages of the prior art and none of the disadvantages.

To attain this, the present invention essentially comprises a free standing monopole tower. The tower is fabricated of tubular steel for use in the telecommunications industry capable of supporting antennas used in AM, CATV, FM, Microwave Cellular TV, VHF and the like. The tower has an upper end and a lower end and an intermediate extent. The lower extent includes a reinforced concrete foundation supporting the tower.

Next provided is a plurality of collar assemblies. The collar assemblies are fabricated of steel, preferably hot-dipped galvanized steel. The collar assemblies are positioned around the tower at spaced locations. The collar assemblies include a lower collar assembly and an upper collar assembly. Each collar assembly is composed of two semi-octagonal sections having coupling apertures with bolts and nuts there between and four radially projecting arms with horizontal holes there through.

Four anchor assemblies are next provided. The anchor assemblies are fabricated of hot dipped galvanized steel. Each anchor assembly includes one vertical post having an upper end and a lower end. Each anchor assembly further includes two diagonal posts having upper ends and lower ends. The lower ends of all the posts have a screw anchor. Each anchor assembly is coupled to the ground in a rectangular configuration positioned around the tower. Each anchor assembly includes a bracket receiving one vertical post and two diagonal posts. Each bracket has a lower cable aperture and an upper cable aperture there through.

Four upper guy cables and four lower guy cables are next provided. An upper guy cable and a lower guy cable for each bracket couple one arm of each collar assembly through a standard shackle with the upper and lower cable apertures of an associated bracket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anchored monopole upgrade system which has all of the advantages of the prior art pole and pole supports of known designs and configurations and none of the disadvantages.

It is another object of the present invention to provide a new and improved anchored monopole upgrade system which may be easily and efficiently manufactured, marketed, and installed.

It is further object of the present invention to provide a new and improved anchored monopole upgrade system which is of durable and reliable constructions.

An even further object of the present invention is to provide a new and improved anchored monopole upgrade system which is susceptible of a low cost of manufacture with regard to both materials and labor, and which accordingly is then susceptible of low prices of sale to the consuming public, thereby making such anchored monopole upgrade system economically available to the buying public.

Even still another object of the present invention is to provide an anchored monopole upgrade system for safely and efficiently supporting a monopole tower with antennas.

Lastly, it is an object of the present invention to provide a new and improved monopole system having a free standing monopole tower and at least one collar assembly positioned around the tower having a plurality of radially projecting arms with holes. A plurality of anchor assemblies, each coupled to the ground around the tower and including a bracket with an aperture therethrough. A plurality of guy cables coupling one leg of each collar assembly an aperture of an associated bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
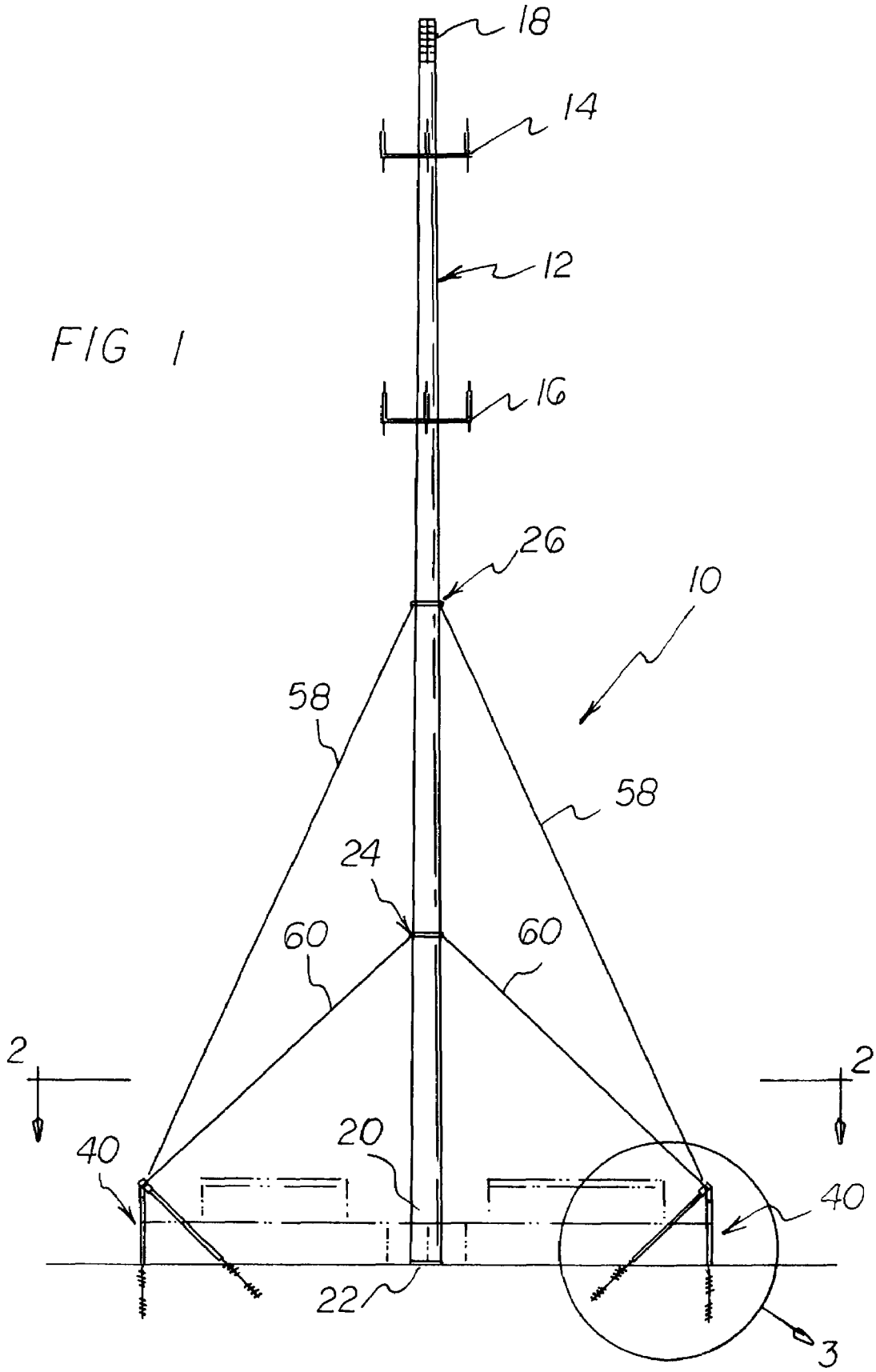
FIG. 1 is a side elevational view of the anchored monopole upgrade system constructed in accordance with the principles of the present invention.
Figure 2:
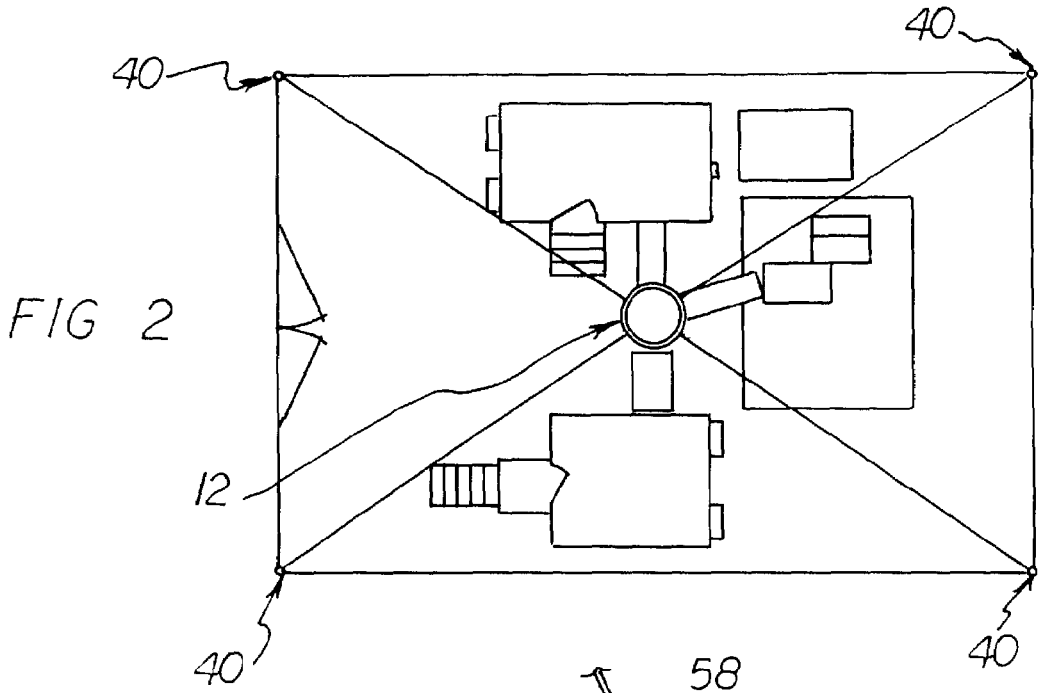
FIG. 2 is a top elevational of the system taken along line 2—2 of FIG. 1.
Figure 3:
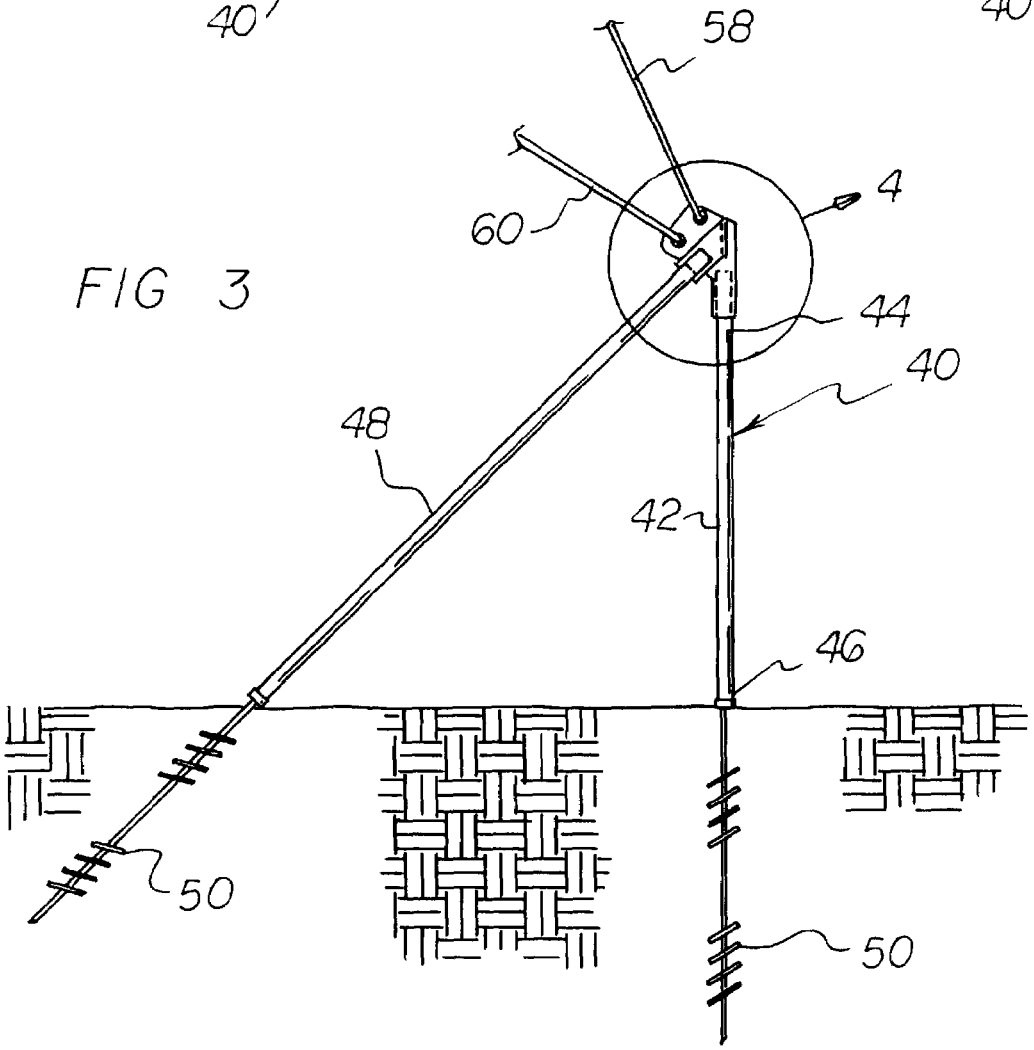
FIG. 3 is an enlarged side elevational view taken at circle 3 of FIG. 1.
Figure 4:
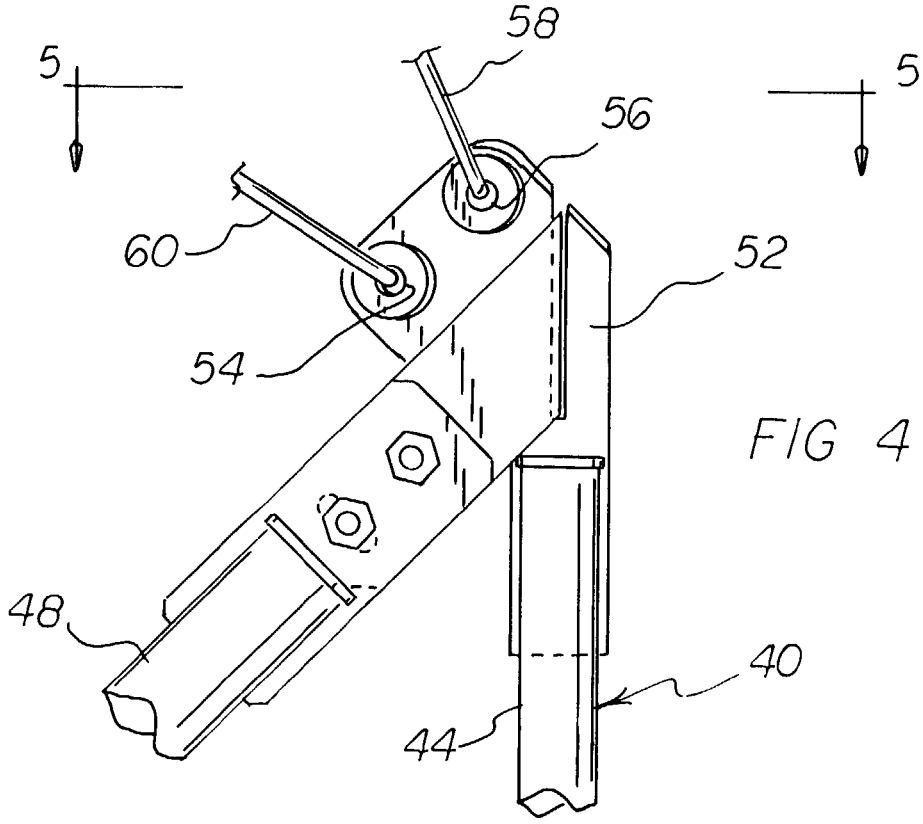
FIG. 4 is an enlarged side elevational view taken at circle 4 of FIG. 3.
Figure 5:
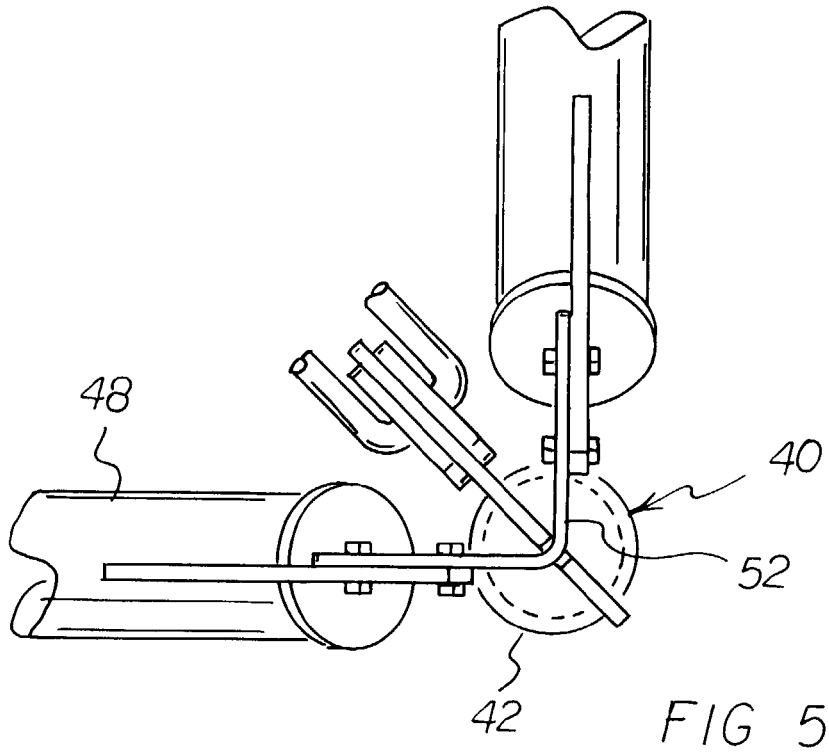
FIG. 5 is a top plan view taken along line 5—5 of FIG. 4.
Figure 6:
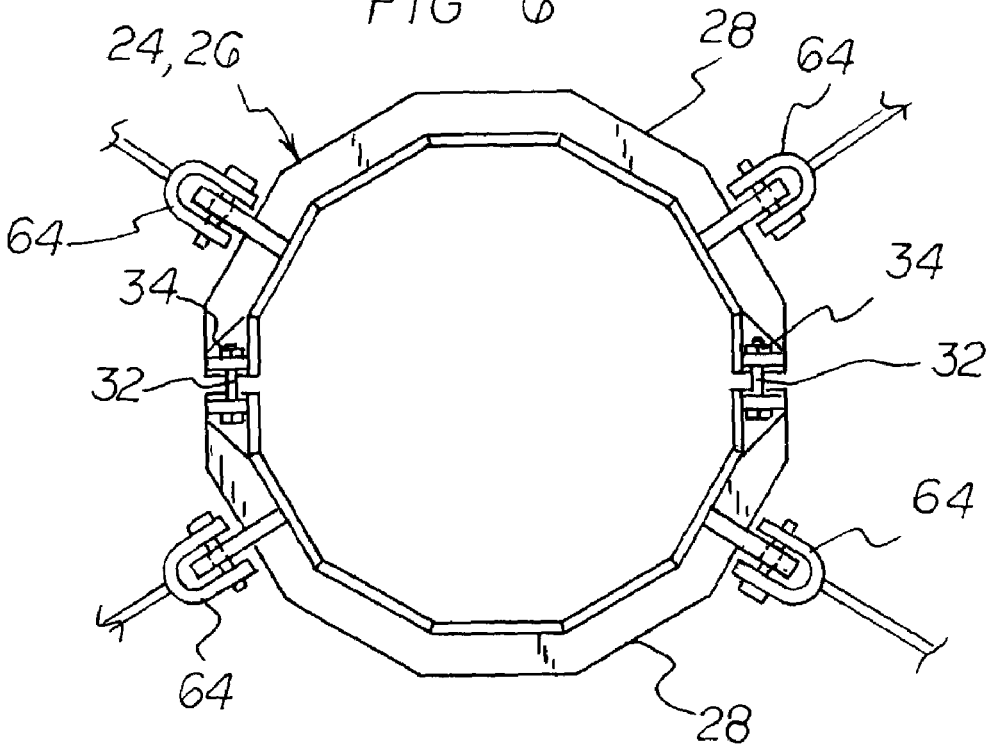
FIG. 6 is a side elevational view of one of the ocllars shown in FIGS. 1 and 2.
Figure 7:
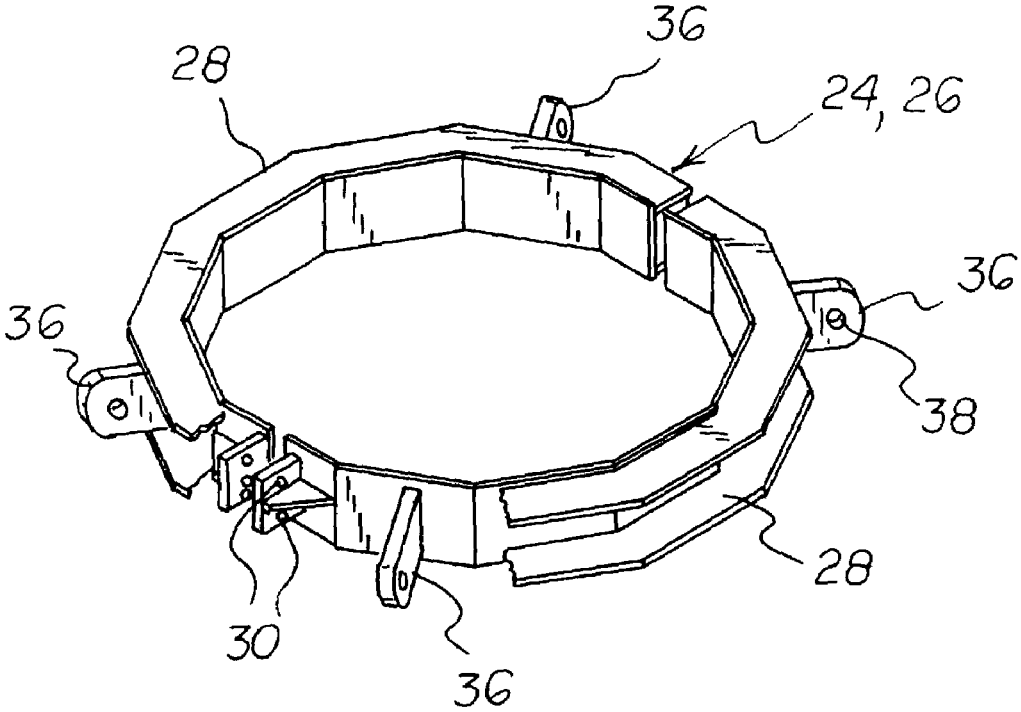
FIG. 7 is a perspective illustration of the collar shown in FIGS. 1, 2 and 6.

With reference now to the drawings, and in particular to FIG. 1 thereof, the preferred embodiment of the new and improved anchored monopole upgrade system embodying the principles and concepts of the present invention and generally designated by the reference numeral 10 will be described.

The present invention, the anchored monopole upgrade system 10 is comprised of a plurality of components. Such components in their broadest context include a monopole tower, a plurality of collar assemblies, four anchor assemblies, four upper guy cables and four lower guy cables. Such components are individually configured and correlated with respect to each other so as to attain the desired objective.

First provided is a free standing monopole tower 12. The tower is fabricated of tubular steel for use in the telecommunications industry capable of supporting antennas 14, 16 used in AM, CATV, FM, Microwave Cellular TV, VHF and the like. The tower has an upper end 18 and a lower end 20 and an intermediate extent. The lower extent includes a reinforced concrete foundation 22 supporting the tower.

Next provided is a plurality of collar assemblies. The collar assemblies are fabricated of steel, preferably hot-dipped galvanized steel. The collar assemblies are positioned around the tower at spaced locations. The collar assemblies include a lower collar assembly 24 and an upper collar assembly 26. Each collar assembly 24, 26 is composed of two semi-octagonal sections 28 having coupling apertures 30 with bolts 32 and nuts 34 there between and four radially projecting arms 36 with cable apertures 38 there through. In the preferred embodiment, two collar assemblies 24, 26 are provided. Alternatively, there may be only one collar assembly.

Four anchor assemblies 40 are next provided. The anchor assemblies 40 are fabricated of hot dipped galvanized steel. Each anchor assembly 40 includes one vertical post 42 having an upper end 44 and a lower end 46. Each anchor assembly 40 further includes two diagonal posts 48 having upper ends and lower ends. The lower ends of all the posts 42, 48 have a screw anchor 50. Each anchor assembly 40 is coupled to the ground in a rectangular configuration positioned around the tower 12. Each anchor assembly 40 includes a bracket 52 receiving one vertical post 42 and two diagonal posts 48. Each bracket 52 has a lower cable aperture 54 and an upper cable aperture 56 therethrough.

Four upper guy cables 58 and four lower guy cables 60 are next provided. An upper guy cable 58 and a lower guy cable 60 for each bracket 52 couple one arm 36 of each collar assembly 24, 26 through a standard shackle 64 with the upper and lower apertures 54, 56 of an associated bracket 52.

A traditional monopole tower 12 is a free-standing, tubular steel structure that is frequently used in the telecommunications industry for supporting antennas used in AM, CATV, FM, Microwave, Cellular, TV, VHF, etc. The main components of the monopole tower 12 are the pole itself, a base plate, anchor bolts, and a reinforced concrete foundation. The pole consists of either tapered or straight tubular sections stacked on top of each other and connected through the use of either flange-to-flange connections or nested joints, otherwise known as splices. A steel base plate is welded to the bottom pole section. The base plate is attached to the reinforced concrete foundation with anchor bolts embedded into the foundation. Alternatively, the pole may be buried in the ground rather than attached to a foundation.

A traditional monopole tower 12 behaves much like a cantilevered beam, with the ground surface acting as the fixed end. The tower 12 is subject to dead, wind, and ice loads. The application of these loads results in axial loads, moments, and shears along the entire height of the pole. The pole structure at each elevation must be capable of resisting these loads. At the tower base there is an overall axial load, base overturning moment, and base shear that must be resisted by the base plate, anchor bolts, and reinforced concrete foundation. When any of these components are incapable of resisting the loads imposed by a proposed equipment installation, the tower 12 must be upgraded or strengthened before the proposed equipment may be installed. This is where the present invention may be utilized.

The basic purpose of the design of the present invention is to provide additional lateral support for the monopole tower 12 through the installation of guy cables 58, 60 at various elevations on the tower 12. In essence, the guy cables 58, 60 will absorb the applied lateral goods and carry these loads to newly constructed tripod anchor assemblies 40 located some distance, radius, from the base of the tower 12. Typically, the anchor assemblies 40 will coincide with the corners of the compound that the monopole tower 12 is contained within.

The present invention consists of elevated tripod anchor assemblies 40, guy cables 58, 60 and collar assemblies 24, 26. The collar assemblies 24, 26 are custom fabricated to fit around the pole at a specified elevation. The collar assemblies 24, 26 are fabricated from steel plates welded together. Plate gussets are welded to the collar assembly 24, 26 for the connection of a guy cable 58, 60.

The elevated tripod anchor assemblies 40 consist of three parts. The vertical post 42 is a 4 inch diameter pipe with a connection assembly welded to the top. A helical pier, screw anchor, or other foundation system, is drilled into the ground and the vertical post 42 is attached to the top of the helical pier, or other foundation system with a coupling. Two helical piers, or other foundation system, are drilled at 45 degrees from the vertical, starting 12 feet from the vertical post 42. The diagonal posts 48 are attached to these helical piers, or other foundation system, with a coupling. Each diagonal post 48 is attached to the bracket 52 with two 1 inch diameter, high strength bolts. The guy cables 58, 60 are then attached to the bracket 52.

With a traditional monopole tower 12, the lateral wind loads are transferred to the foundation through bending, overturning moment, of the cantilever pole. With the present invention, the lateral loads are transferred to the foundation through bending of the cantilever pole and through tension in the guy cables 58, 60 to the tripod anchors assemblies 40. The dead weight of the tower 12 as well as additional vertical load due to the tensioning of the guy cables 58, 60 is transferred axially through the tower 12 directly into the original monopole foundation.

The benefits of the system include distribution of lateral load, wind load, into the guy system, thereby reducing all loads in the tower 12 thereby increasing the available capacity. The elevated anchor assemblies 40 allow for a minimum of 12 foot clearance below the guy cables 58, 60, increasing usable space, and increasing the guy radius from the tower 12. This also increased the safe working area. The system can be installed in a relatively small land area. The vertical post 42 can double as a corner fence post. The system can be installed in a relatively short period of time. The system has negligible impact on compound access and clearances. The system reduces upgrade costs and time over conventional upgrade systems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An anchored monopole upgrade system for safely and efficiently supporting a monopole tower with antennas comprising:

a free standing monopole tower fabricated of tubular steel for use in the telecommunications industry capable of supporting antennas used in AM, CATV, FM, Microwave Cellular TV, VHF and the like; the tower having an upper end and a lower end and an intermediate extent there between, the lower extent including a reinforced concrete foundation supporting the tower;

a plurality of collar assemblies fabricated of steel positioned around the tower at spaced locations including a lower collar assembly and an upper collar assembly, each collar assembly being composed of two polygonal sections, said polygonal sections having coupling apertures to receive bolts and nuts for securing the two polygonal sections together and four radially projecting arms with cable apertures therein;

four anchor assemblies fabricated of hot dipped galvanized steel, each anchor assembly including one vertical post having an upper end and a lower end and two diagonal posts having upper ends and lower ends, the lower ends of all the posts having a screw anchor, each anchor assembly coupled to the ground in a rectangular configuration positioned around the tower, each anchor assembly including a bracket receiving one vertical post and two diagonal posts, each bracket having a lower cable aperture and an upper cable aperture therein; and four upper guy cables and four lower guy cables, an upper guy cable and a lower guy cable for each bracket coupling one projecting arm of each collar assembly through a standard shackle with the upper and lower cable apertures of an associated bracket.

2. An anchoring system for a monopole tower comprising:

a. at least one split collar assembly having first and second separable sections adapted to fit around said monopole tower at a desired location above the ground;

b. a plurality of anchor assemblies for engagement with the ground at spaced locations around the monopole tower said anchor assemblies comprising:

at least three diverging legs forming a multi-leg support structure, each said leg including a ground-engaging members for securing said legs in the ground;

a bracket for securing said legs together to form said multi-leg support structure, said bracket including a connecting member having cable apertures formed therein for attaching said guy cables to said bracket; and c. a plurality of guy cables connecting the collar assembly to said anchor assemblies, each guy cable extending from said collar to a respective one of said cable assemblies.

3. The anchoring system of claim 2 wherein each collar assembly includes a plurality of radially projecting arms with cable apertures formed therein for attaching to said guy cables.

4. The anchoring system of claim 2 wherein the collar assembly has a polygonal configuration.

5. The anchor assembly of claim 2 wherein said bracket includes an opening to receive said vertical leg.

6. The anchor assembly of claim 5 wherein said bracket includes a pair of arms for attaching to said diagonal legs.

7. The anchor assembly of claim 6 wherein said connecting member includes at least one cable aperture for attaching said guy cable.

8. The anchor assembly of claim 7 wherein said connecting member includes at least two cable apertures for attaching two or more guy cables.

9. An anchor assembly for use in anchoring a monopole tower, said anchor assembly comprising:

at least three diverging legs forming a multi-leg support structure, each said leg including a ground-engaging member for securing said leg to the ground;

a bracket for connecting said legs to form a multi-leg support structure;

a connecting member on said bracket for attaching a guy cable to said anchor assembly.

10. The anchor assembly of claim 9 wherein said bracket includes an opening to receive said vertical leg.

11. The anchor assembly of claim 10 wherein said bracket includes a pair of arms for attaching to said diagonal legs.

12. The anchor assembly of claim 11 wherein said connecting member includes at least one cable aperture for attaching said guy cable.

13. The anchor assembly of claim 12 wherein said connecting member includes at least two cable apertures for attaching two or more guy cables.

* * * * *